US009416430B2

(12) United States Patent
Guest

(10) Patent No.: US 9,416,430 B2
(45) Date of Patent: Aug. 16, 2016

(54) APPARATUS FOR INDUCING FLOW IN A MOLTEN MATERIAL

(75) Inventor: Graham Guest, Wolverhampton (GB)

(73) Assignee: FIVES SOLIOS LIMITED, Wolverhampton (GB)

( * ) Notice: Subject to any disclaimer, the term of this patent is extended or adjusted under 35 U.S.C. 154(b) by 544 days.

(21) Appl. No.: 13/984,106

(22) PCT Filed: Feb. 27, 2012

(86) PCT No.: PCT/GB2012/050435

§ 371 (c)(1),
(2), (4) Date: Sep. 10, 2013

(87) PCT Pub. No.: WO2012/120276

PCT Pub. Date: Sep. 13, 2012

(65) Prior Publication Data

US 2014/0291899 A1 Oct. 2, 2014

(30) Foreign Application Priority Data

Mar. 9, 2011 (GB) ..... 1103986.4

(51) Int. Cl.
*F27D 27/00* (2010.01)
*C21C 5/52* (2006.01)
(Continued)

(52) U.S. Cl.
CPC ..... *C21C 5/5241* (2013.01); *B01F 13/0809* (2013.01); *C21C 5/527* (2013.01);
(Continued)

(58) Field of Classification Search
CPC ... B01F 13/0809; C21C 5/5247; F27D 27/00; F27D 3/14
USPC ..... 222/594, 590; 266/234
See application file for complete search history.

(56) References Cited

U.S. PATENT DOCUMENTS 4,079,920 A * 3/1978 Mischenko ..... F27B 3/19 222/594
2004/0135297 A1* 7/2004 Houghton ..... B01F 13/0809 266/234
2014/0291899 A1* 10/2014 Guest ..... B01F 13/0809 266/44

FOREIGN PATENT DOCUMENTS

FR 2633708 A1 6/1988
GB 1520210 8/1978
WO 03/106908 A1 12/2003

OTHER PUBLICATIONS

PCT International Preliminary Report on Patentability re International application No. PCT/GB2012/050435, filing date Feb. 27, 2012.

(Continued)

*Primary Examiner* — Scott Kastler
(74) *Attorney, Agent, or Firm* — Chernoff, Vilhauer, McClung & Stenzel

(57) ABSTRACT

The apparatus includes a furnace having a furnace chamber (14), a port (16) in fluid communication with the furnace chamber having an inclined lower wall (18), and a bi-directional induction unit (24) mounted to the inclined lower wall for inducing flow in molten material in the port. A retractable channel plate assembly (26) is selectively positionable in the port to define an extraction flow channel (28) for the molten material between the channel plate assembly and the inclined lower wall. A drive arrangement (64) moves the channel plate assembly into and out of the port and the control of a control system (74) which includes a sensor system (78) for measuring the level of the molten material in the port and a feedback system for providing information regarding the position of the channel plate assembly. A method of operating the apparatus is also disclosed.

26 Claims, 8 Drawing Sheets

(51) Int. Cl.

| | |
|---|---|
| ***B01F 13/08*** | (2006.01) |
| ***F27B 3/02*** | (2006.01) |
| ***F27B 3/04*** | (2006.01) |
| ***F27B 3/10*** | (2006.01) |
| ***F27B 3/19*** | (2006.01) |
| ***C21C 7/00*** | (2006.01) |
| ***F27D 3/14*** | (2006.01) |
| ***F27D 11/06*** | (2006.01) |
| *F27D 3/00* | (2006.01) |

(52) U.S. Cl.

CPC ..... *C21C 5/5211* (2013.01); *C21C 5/5247* (2013.01); *C21C 7/00* (2013.01); *F27B 3/02* (2013.01); *F27B 3/045* (2013.01); *F27B 3/10* (2013.01); *F27B 3/19* (2013.01); *F27D 3/14* (2013.01); *F27D 11/06* (2013.01); *F27D 27/00* (2013.01); *F27D 2003/004* (2013.01)

(56) References Cited

OTHER PUBLICATIONS

International Search Report and Written Opinion of the International Search Report for PCT/GB2012/050435, completed Jul. 13, 2012, mailed Jul. 20, 2012, 11 pages.

* cited by examiner

APPARATUS FOR INDUCING FLOW IN A MOLTEN MATERIAL

CROSS-REFERENCE TO RELATED APPLICATION

This is a national stage application filed under 35 USC 371 based on International Application No. PCT/GB2012/050435 filed Feb. 27, 2012, and claims priority under 35 USC 119 of Great Britain Patent Application No. 1103986.4 filed Mar. 9, 2011.

The present application relates to apparatus for inducing flow in an electrically conductive molten material. In particular, the invention relates to apparatus comprising a furnace having a port and an electromagnetic induction unit mounted to the port which can be used in a first mode to stir molten materials within a chamber of the furnace and in a second mode to extract molten material from furnace chamber through the port for casting or other purposes. The invention also relates to a method of operating such apparatus.

Throughout this specification, including the claims, references to "molten material" should be understood as referring to electrically conductive molten material unless specifically stated otherwise. Furthermore, references to "metal", including "molten metal", should be understood as encompassing alloys which may include non-metallic materials or additives provided that the material as a whole remains electrically conductive.

It is known to provide furnaces for the melting and refining of metal materials, including aluminium, or other materials. Furnaces have also been used to recycle scrap metal. The surfaces of a furnace or other apparatus which are in contact with or immersed in the molten material will typically be made of, or lined with, a refractory material. In this context, a refractory material can be any suitable material which is chemically and physically stable at the high temperatures encountered and which are substantially unaffected by the molten material in question.

It is accepted that the melting and refining process can be improved by stirring the molten metal in the furnace chamber. Stirring the molten metal distributes heat more evenly throughout the melt and so improves the efficiency of the process. Where additional solid-state materials, such as scrap metal for recycling and/or additives, are introduced into the melt in the furnace, stirring can assist in mixing the solid state material with the melt more quickly.

It is known to provide a stirring apparatus in the form of an electromagnetic induction unit (a type of linear induction motor) positioned underneath the furnace in a horizontal plane adjacent a bottom wall of the furnace. The magnetic field created by the induction unit acts through a relatively thick steel plate and internal refractory lining on the bottom of the furnace to stir the molten material slowly in a horizontal plane, in an attempt to disperse the heat evenly throughout the melt. However, it is believed that such a treatment of molten metal may have disadvantages at least in certain applications. For example, when additional scrap metal material or alloy additives such as silicon are introduced into the furnace on top of the melt, the stirring action provided by the electromagnetic induction unit does not contribute greatly to mixing the new scrap metal material/additives evenly throughout the melt. Often the scrap metal material/additive will be quite light (particularly a silicon additive) and will simply float on the surface of the melt as it is stirred around in a horizontal plane rather than, for example, being dragged downwardly into the molten metal where it can be melted and mixed much more quickly and effectively. Once again, scrap metal with a high surface area to mass ratio (for example shredded aluminium drink cans) will simply float on the top of the melt and become oxidised rather than being submerged within the bath to be melted down and recycled in an efficient manner.

Furthermore, in order to stir the metal, it is necessary that the induction unit provide a deep magnetic field that propagates through the furnace construction to penetrate into the molten material in the furnace. This requires the induction device to be operated at very low frequencies, typically 1 Hz or less. Consequently the speed of stirring is relatively low.

The applicant has proposed in WO 03/106668 to mount an electromagnetic induction unit on an inclined lower wall of a furnace port to induce a flow in the molten metal having both a vertical and a horizontal component in the furnace chamber. This arrangement can be used to help draw scrap materials or additives down into the molten material to aid in mixing. As described, the electromagnetic induction unit sets up a circulating flow of material in the furnace chamber by creating a downward flow of material in the port at one end. Because the electromagnetic field does not have to penetrate as far into the molten material as with the previously known arrangements, it is possible to use an electromagnetic induction unit capable of operating at frequencies up to 60 Hz but which produces a shallower magnetic field. This is advantageous as it enables relatively fast flow rates to be achieved, leading to improved flexibility in mixing.

It is also known to use an induction unit mounted to an inclined lower wall of a furnace port to induce an upward flow so as to draw molten metal out of the furnace chamber through the port for casting. In order to create a flow, the upward forces induced in the molten metal have to overcome frictional resistance and gravitational forces. In the known arrangements this requires the use of a channel plate permanently fixed in the refractory lining of the lower wall of the chamber to define a restricted channel in the port adjacent to the inductor unit through which the molten metal can be pumped by the induction unit to a casting feed launder. A typical known arrangement is illustrated in FIG. 1 which shows in cross-section one end of a furnace 1 having a chamber 2 and an extraction port 3 leading to a casting feed launder or trough 4. An induction unit 5 is mounted to the outside of an inclined lower wall 6 of the port and a channel plate 7 made of refractory material is permanently fixed in the refractory lining of the lower wall to define a narrow, restricted channel 8. The induction unit 5 is operated so as to induce an upward flow in the molten metal in the channel 8 so that molten metal is pumped from the furnace chamber 2 into the casting feed launder 4.

Both known arrangements work well but, so far as the applicant is aware, no known arrangements have yet been developed that allow an induction unit on the port of a furnace to be used selectively both to stir the molten metal in the furnace chamber and as a pump to extract the molten metal from the furnace chamber through the port. This is because with the channel plate in position, the induction unit is unable to set up a circulation of molten metal in the furnace chamber to produce effective stirring whilst if the channel plate is omitted the induction unit is unable to induce an upwards flow of the molten metal in the port to pump the molten metal from the furnace chamber into the cast feed launder in a controlled manner. Accordingly, the known arrangements are set up for either stirring or extraction but not both. Whilst it would be possible to provide two ports on a furnace each having an induction unit and to set up one port so the induction unit is operative to stir the metal in the furnace chamber and to set up the other as an extraction port, this adds considerably to the cost of the apparatus and may not be possible where space restrictions do not permit the use of a second port.

It is an objective of the invention to provide improved apparatus for inducing a flow in an electrically conductive molten material that overcomes, or at least, mitigates the drawbacks of the known arrangements.

It is a further objective of the invention to provide improved apparatus comprising a furnace having a port and an electromagnetic induction unit mounted to the port which can be used in a first mode to stir the molten material within a chamber of the furnace and in a second mode to extract molten material from the furnace chamber through the port for casting or other purposes.

It is a further objective of the invention to provide an improved method of operating the apparatus.

In accordance with a first aspect of the invention, there is provided apparatus for inducing flow in a molten material, the apparatus comprising a furnace having a furnace chamber, a port in fluid communication with the furnace chamber and having an inclined lower wall, a bi-directional induction unit mounted to the inclined lower wall of the port for inducing flow in molten material in the port, a retractable channel plate assembly selectively positionable in the port to define an extraction flow channel for the molten material between the channel plate assembly and the inclined lower wall, a drive arrangement for moving the channel plate into and out of the port, a control system for controlling the drive system, the control system including a sensor system for measuring the level of the molten material in the port and a feedback system for providing information regarding the position of the channel plate assembly.

The apparatus in accordance with the first aspect of the invention can be operated in a stirring mode to stir molten material in the furnace chamber or in an extraction mode in which molten material is drawn out of the furnace chamber through the port for casting or other purposes. In the stirring mode, the channel plate assembly is retracted from the port and the induction unit is operated in a first direction so as to induce a downward flow of molten material from the port into the furnace chamber. In the extraction mode, the induction unit is operated in a second, reverse direction so as to induce an upward flow of molten material from the furnace chamber along the lower wall of the port and the channel plate assembly is gradually introduced into the port by the drive system operating under control of the control system whilst extraction is taking place so that an extraction channel through which the material can flow to exit the port is formed between the channel plate assembly and the inclined lower wall of the port. The control system regulates the drive system in response to information from the sensing system and the feedback system so that only a leading edge region of the channel plate assembly is immersed in the molten material, with the channel plate assembly being advanced further into the port as the level of the molten material falls to maintain the leading edge region immersed in the molten material.

The control system may be configured to advance the channel plate assembly into the port continuously in response to a fall in the level of the molten material as detected by the sensor system to maintain a leading edge region immersed in the molten material substantially at a desired immersion depth D.

Alternatively, the control system may be configured to advance the channel plate assembly into the port incrementally in discrete steps in response to a fall in the level of the molten material as detected by the sensor system to maintain a leading edge region immersed in the molten material. The control system may be configured to actuate the drive system to advance the channel plate assembly until the leading edge region is immersed to predetermined mean immersion depth D plus an offset X and to then hold the channel plate stationary, the control system being configured to subsequently reactuate the drive system to advance the channel plate assembly further when the immersion depth falls to D−X until the immersion depth returns to D+X and to repeat the step sequence advance until extraction is complete.

A leading edge region of the channel plate assembly may be made wholly of refractory materials. The channel plate assembly may comprise a supporting structure made of non-refractory materials to which refractory materials are mounted to form the leading edge region and a lower face which defines the extraction flow channel. The supporting structure may be made of metal such as steel. The supporting structure may comprise a mounting plate to which the refractory materials are mounted. The mounting plate may be laminated and may comprise a plurality of longitudinal strips attached together. The strips may be made of steel and may be welded together. The refractory materials may comprise a plurality of refractory plate sections mounted to the supporting structure and including a leading plate section, a portion of which extends beyond the supporting structure to form the leading edge region of the channel plate assembly. The portion of the leading plate section which extends beyond the supporting structure may have a vertical fin on its upper surface which abuts with the supporting structure. The fin may be attached to the supporting structure.

A lower face of the channel plate assembly which opposes the lower wall of the port may be profiled to define the extraction flow channel. The lower face of the channel plate assembly may be profiled to define a groove running along the length of the channel plate assembly.

The channel plate assembly may be mounted to a support for movement into and out of the port. The support may be configured to hold the channel plate assembly in an insertion orientation in which a lower face of the channel plate is aligned substantially parallel to the inclined lower wall of the port for insertion into the port. The support may be movable so that the channel plate assembly can be moved away from the insertion orientation when it is retracted from the port. The support may include a slide rail and a slide assembly mounted to the slide rail for movement along the rail, the channel plate assembly being mounted or forming part of the slide assembly. The slide rail may be pivotally mounted to a stationary support frame for movement between an inclined position in which it supports the channel plate assembly in the insertion orientation and an upright position.

The drive system may be mounted on the support.

The drive system may comprise a ball screw actuator.

The drive system may comprise a chain drive mechanism.

The system for measuring the level of molten material may comprise a laser measurement system.

The control system may comprise a programmable control unit having a CPU and memory.

The furnace may be a metal casting furnace.

In accordance with a second aspect of the invention, there is provided a method of operating apparatus in accordance with the first aspect, the method comprising: selectively operating the apparatus in either one of a stirring mode to stir molten material in the furnace or an extraction mode to draw molten material from the furnace chamber through the port.

When the apparatus is operated in the stirring mode, the method may comprise operating the induction unit in a first direction so as to induce a downward flow of molten material from the port into the furnace chamber with the channel plate assembly retracted from the port.

When the apparatus is operated in the extraction mode, the method may comprise operating the induction unit in a second direction so as to induce an upward flow of molten material from the furnace chamber along the lower wall of the port and using the drive system operating under the control of the control system to advance the channel plate assembly into the port so that only a leading edge region of the channel plate assembly is immersed in the molten material.

The method may comprise advancing the control plate into the port continuously as the level of the molten material falls so as to maintain the leading edge region immersed in the molten material substantially at a desired immersion depth D.

Alternatively, the method may comprise advancing the channel plate assembly incrementally in discrete steps as the level of the molten material falls. The method may comprise initially advancing the channel plate assembly from a retracted position until the leading edge is immersed to predetermined mean immersion depth D plus an offset X and holding the channel plate assembly stationary as molten material is extracted, advancing the channel plate assembly further once the immersion depth has fallen to D−X until the immersion depth returns to D+X and holding the channel plate assembly stationary again. The method may comprise repeating the step advance sequence until extraction is complete.

Several embodiments of the invention will now be described, by way of non-limiting example only, with reference to the accompanying drawings, in which.

Figure 1:
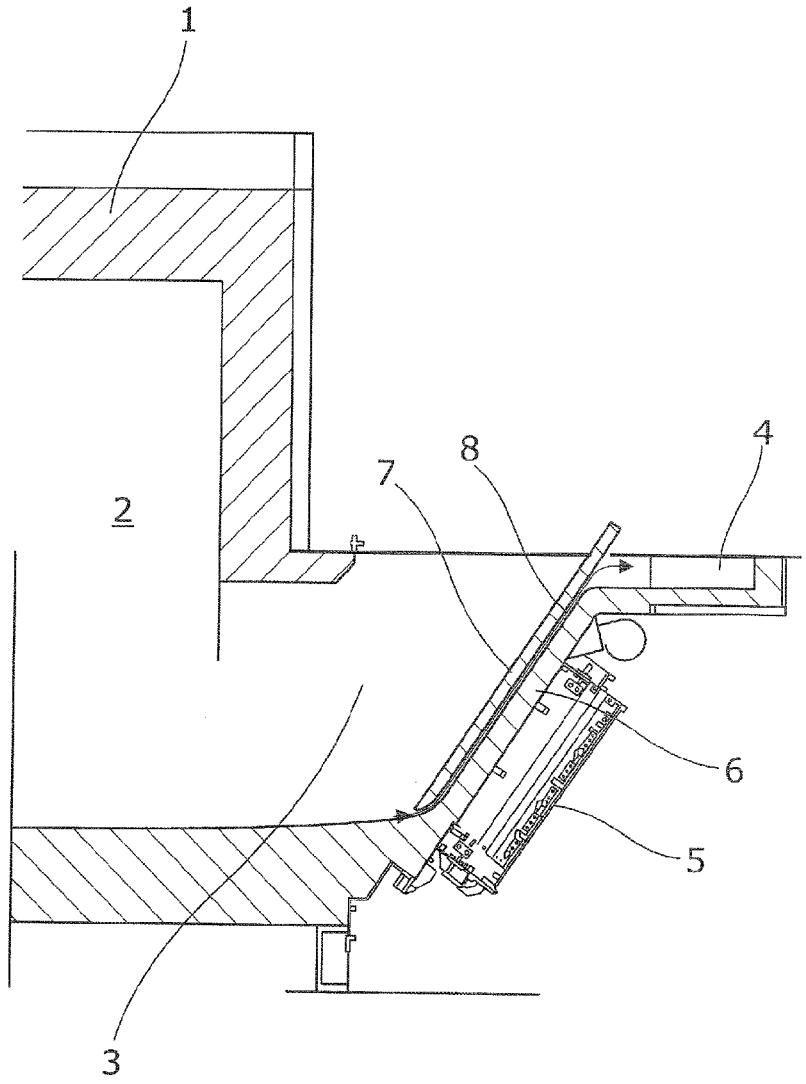
Fig. 1 (Prior Art)
FIG. 1 is a schematic diagram of a prior art arrangement including an induction unit mounted to a furnace port.

Apparatus 10 in accordance with the invention includes a furnace 12 having a main furnace chamber 14 and a port 16 in fluid communication with the main furnace chamber 14. The furnace 12 in this embodiment forms part of apparatus for casting metals and can be of any suitable type. The port is accessible from the top and can be used to introduce material into the furnace, such as additives and/or scrap metal. The port can also be used for extracting molten metal from the furnace chamber for casting.

The port 16 has an inclined lower wall 18 leading to a channel member 20 at the upper end of the port 16. In use, the channel member can be extended outwardly by connecting additional channel members to form an extraction chute which may be a casting feed launder. In cross-section, the port 16 is shaped generally as a right-angled triangle, with the inclined lower wall 18 being angled at approximately 55° to a vertical end wall 22 of the furnace. However, the port need not be constructed as a right angled triangle and the angle of the inclined wall can be varied to suit the particular application and could, for example, be anywhere in the range of 30° to 66°

The furnace main chamber 14, the port 16 and the channel member 20 are all lined with refractory materials where they are in contact with molten metal in a known manner. Any suitable refractory materials can be used dependant on the nature of the material being processed and the temperatures encountered. The refractory materials lining the inclined lower wall of the port and the channel member may be profiled to define a channel through which molten materials can flow when the apparatus is used in an extraction mode.

Figure 2D:
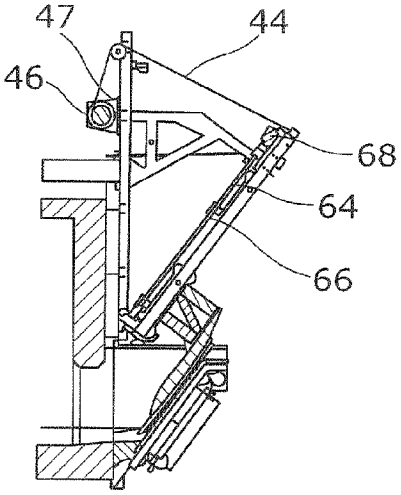
FIGS. 2A to 2D are a series of somewhat schematic cross sectional views through part of an apparatus in accordance with the invention illustrating sequentially how the channel plate assembly is advanced into the port when the apparatus is used in an extraction mode.
Figure 2C:
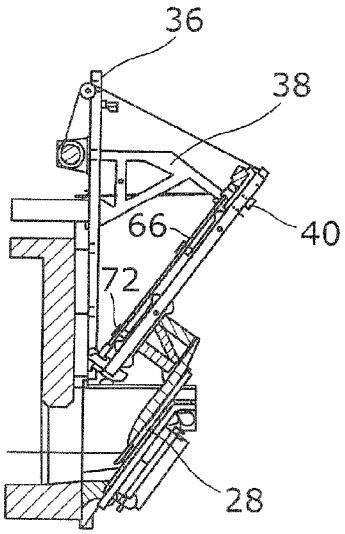
Figure 2B:
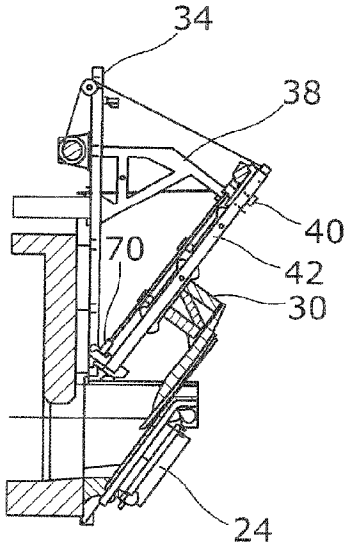
Figure 2A:
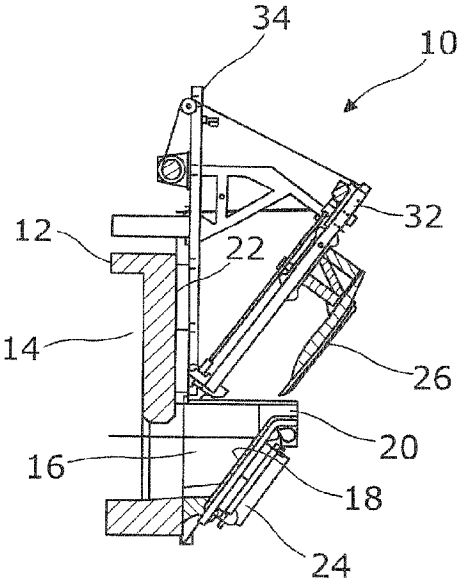
Figure 3:
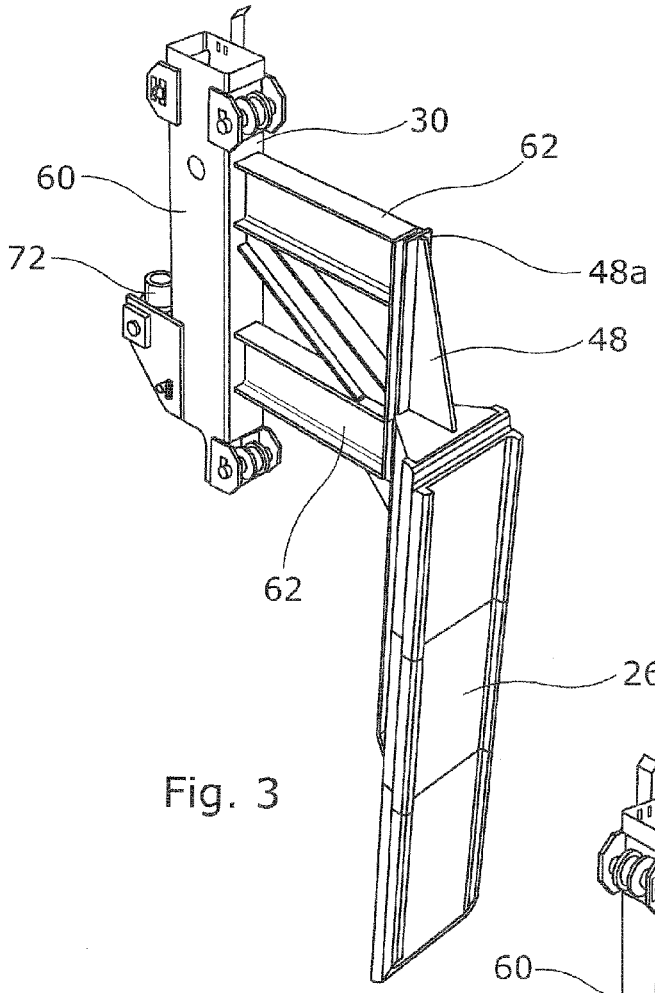
FIG. 3 is a perspective view from below and to one side of a slide assembly forming part of the apparatus of FIGS. 2A to D.
Figure 4:
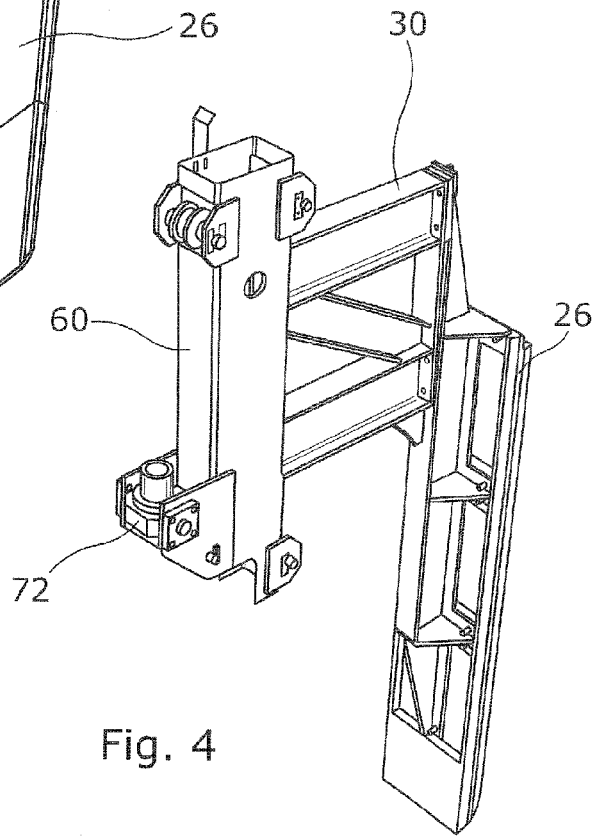
FIG. 4 is a perspective view from above and to one side of the slide assembly of FIG. 3.
Figures 8A, 8B, 8C, 8D:
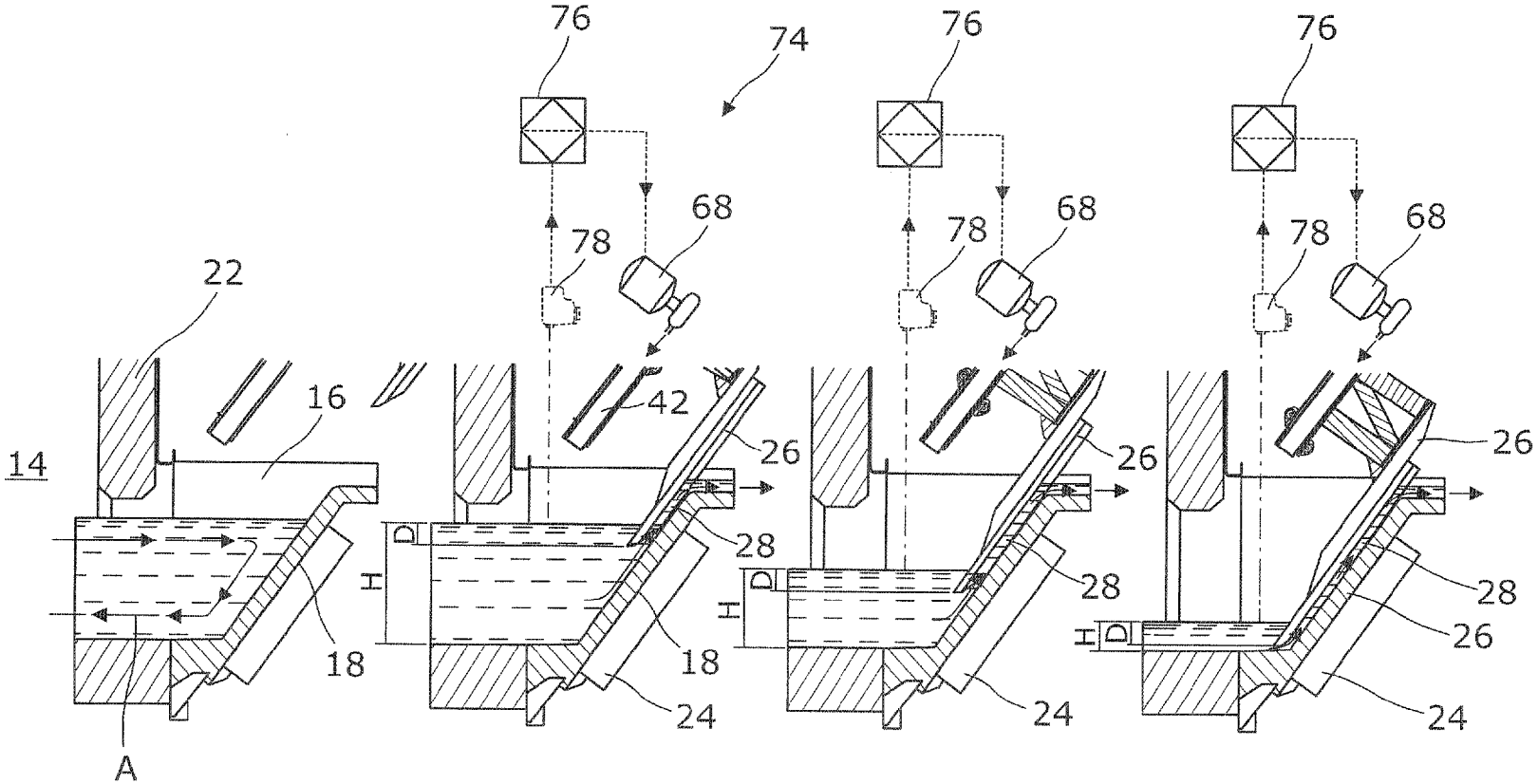
FIGS. 8A to 8D are a series of somewhat schematic views of part of the apparatus of FIGS. 2A to 2D illustrating sequentially a first method for advancing the channel plate assembly into the port when the apparatus is used in an extraction mode.

The apparatus includes an electromagnetic induction unit 24 (in the form of a linear induction motor) mounted to the inclined lower wall 18 of the port 16 for inducing flow in the molten metal in the port 16 and a channel plate assembly 26 which can be selectively retracted from the port, as shown in FIGS. 2A and 8A, or introduced into the port to define an extraction channel 28 together with the lower inclined wall 18 of the port, as illustrated in FIGS. 2B to 2D, FIGS. 8B to 8D and FIGS. 9A and 9B.

The induction unit 24 may be referred to as an induction stirring device or induction motive device as its primary function is to impart a motion to the fluid metal in the furnace and/or the port. Whilst some heat will be generated, this is not the primary purpose of the induction unit and the induction unit is not an induction heating device as such.

The induction unit 24 is bi-directional and can be operated in a first direction to induce a downward force on the metal in the port 16 to set up a flow of material in a downwards direction along the inclined lower wall of the port and into the furnace main chamber 14, as indicated by the arrows A in FIG. 8A. With the channel plate assembly 26 retracted, the downward flow of metal from the port into the main chamber sets up a circulating flow of material in the furnace for stirring the material in the main chamber. The induction unit 24 is operated in the reverse direction when the apparatus is placed in an extraction mode to induce an upward force on the molten metal in the port. Used in conjunction with the channel plate assembly 26 which is gradually introduced into the port to define the extraction channel 28, this sets up a flow of molten metal from the furnace main chamber 14 to the extraction channel member 20 through the extraction channel 28 as illustrated in FIGS. 8B to 8D, 9A and 9B.

The channel plate assembly 26 is mounted to a slide assembly 30 which is itself movably mounted on a support assembly 32. The support assembly 32 includes a static frame 34 having two spaced vertical members 36 (only one of which can be seen) located adjacent the vertical wall 22 of the furnace. A support arm 38 (only one of which can be seen) is rigidly mounted to each of the vertical members 36 and projects forwardly, away from the furnace. The support arms 38 are interconnected at their distal ends by a cross member 40.

The support assembly also includes a slide rail 42 which is pivotally mounted at its lower end to the static support frame 34 at a position between the two vertical members 36. The slide rail 42 is movable from an inclined position as shown in FIGS. 2A to 2D to an upright position (not shown). In the inclined position, the upper end of the slide rail 42 is supported on the frame cross member 40. With the slide rail in the inclined position, the slide assembly 30 and the channel plate assembly 26 are held at a suitable position and orientation for the channel plate assembly to be moved into and out of the port 16 substantially parallel to the inclined lower wall 18. However, when the channel plate assembly 26 is fully retracted, the slide rail 42 can be moved to the upright position to move the slide assembly and channel plate assembly away from the port making access to the port easier. Movement of the slide rail 42 between the inclined an upright positions is controlled by means of a cable 44 attached to the upper end of the slide rail and which is wound to a drum 46 driven by means of an electric motor 47 mounted to one or both of the vertical members 36 of the support frame.

Figure 6:
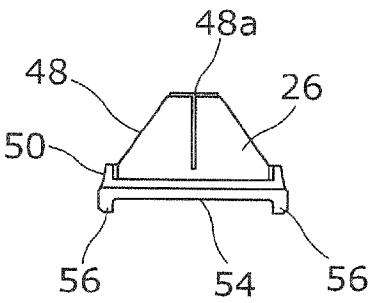
FIG. 6 is an end view of the channel plate assembly of FIG. 5.
Figure 5:
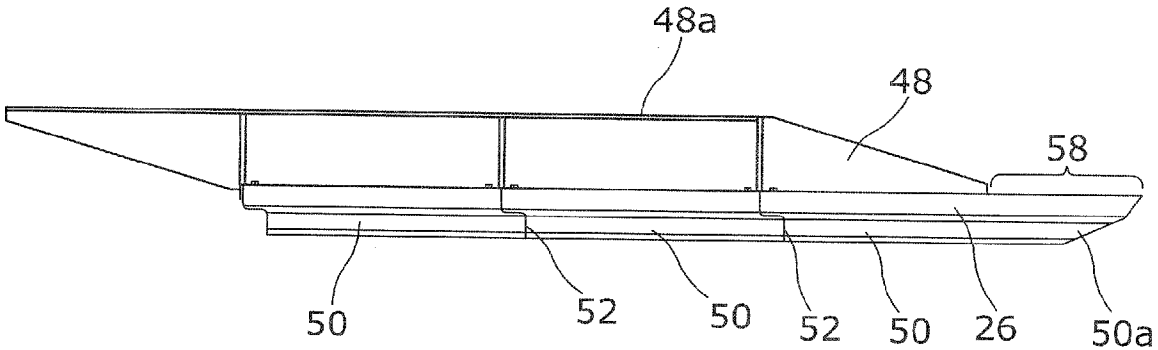
FIG. 5 is a side view of a channel plate assembly forming part of the slide assembly of FIGS. 3 and 4.
Figure 7:
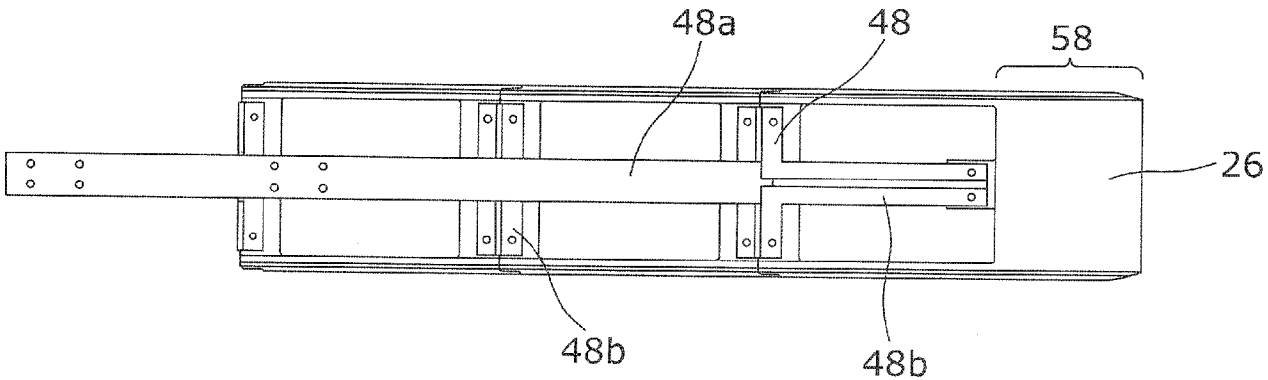
FIG. 7 is a plan view from above of the channel plate assembly of FIG. 5.
Figure 10:
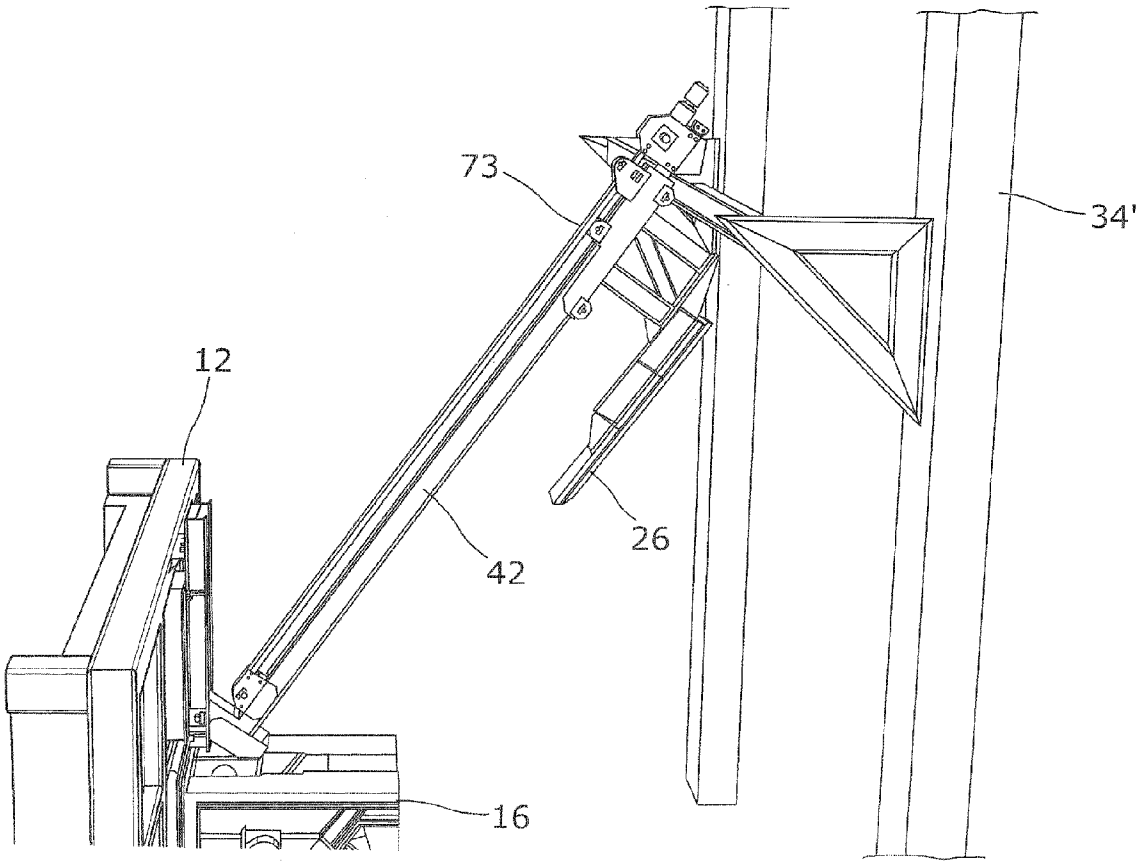
FIG. 10 is a perspective view of part of an apparatus in accordance with a further embodiment of the invention.

In some applications, it may not be necessary or desirable to be able to pivot the slide rail 42 between upright and inclined positions. In this case, the cable winch arrangement 44, 46, 47 can be omitted and the slide rail 42 can be supported in an inclined position at which the slide assembly 30 and the channel plate assembly 26 are aligned for movement into and out of the port using a simplified static support frame 34' for supporting an upper end region of the slide rail 42 as illustrated in FIG. 10. Construction of the channel plate assembly 26 and the slide assembly 30 can be seen best from FIGS. 3 to 7. The channel plate assembly 26 has a metallic supporting framework 48 on is upper surface which does not come into contact with the molten metal in the port. The framework includes a raised mounting portion 48*a* for attachment to the slide assembly 30 and a mounting portion 48*b*. Attached to the mounting section 48*b* of the framework 48 are a number of plate sections 50 which are made of a suitable refractory material and which define a continuous lower surface of the plate for contact with molten metal in the port. The refractory plate sections 50 have profiled connecting edges 52 to prevent or limit migration of molten metal between them. As can be seen best in FIG. 6, the front or lower surface of the refractory plate sections are profiled having a central groove 54 located between two side regions 56 which contact or are placed in very close proximity to the refractory lining on the inclined lower wall 18 of the port. The central groove 54 defines the extraction channel 28 for the molten metal together with the refractory lining on the inclined lower wall, which may also be profiled. The shape and size of the central groove 54 helps to determine the flow rate of the molten metal as it is extracted from the furnace and can be profiled accordingly. Metallic inserts can be located in the refractory material surrounding the central groove 54 to enhance the magnetic filed within the groove.

In the present embodiment, the channel plate assembly 26 has three refractory plate sections but the number of sections can be varied as required for any particular application.

The refractory plate section 50*a* at the leading end of the channel plate assembly 26, projects forwardly beyond the metallic frame work to define a leading edge region 58 of the channel plate assembly which is formed wholly from refractory materials and which can be immersed in the molten metal in the port.

The slide assembly 30 includes a tubular slide member 60 which locates about the slide rail 42 of the support assembly for movement along the slide rail. The slide member 60 may be provided with rollers for contact with the slide rail or other low friction arrangements to allow the slide member 60 to move easily along the slide rail 42. In the present embodiment, both the slide rail 42 and the slide member are rectilinear in cross section so that the slide member does not rotate about the slide rail and holds the channel plate assembly 26 in the desired orientation. A pair of struts 62 project from the slide member to which the raised mounting portion 48*a* of the channel plate assembly frame is attached. The channel plate 26 assembly may be formed as an integral part of the slide assembly.

The apparatus 10 has a drive system 64 for moving the slide assembly 30 along the slide rail 42, and hence moving the channel plate assembly 26 relative to the port 16. Any suitable drive system can be used but in the present embodiment the drive system comprises a ball screw type actuator having a lead screw 66 which is driven by an electric motor 68 through a gearbox. The motor and gear box 68 are mounted to the upper end of the slide rail and the lead screw extends parallel to the slide rail with its lower end received in a bearing 70 fixed relative to the lower end of the slide rail. The lead screw 66 passes through a ball nut drive unit 72 attached to the slide assembly so that rotary movement of the screw is converted into linear movement of the slide assembly along the slide rail 42. In an alternative embodiment, a chain drive system (indicated generally at 73 in FIG. 10) can be used to move the slide assembly 30 along the slide rail 42. For safety reasons, a double chain drive arrangement can be used so that the slide assembly 30 does not drop into the port in the event of one of the chains breaking.

Movement of the slide assembly 30, and hence the channel plate assembly 26, is controlled by an electronic control system 74 which includes a programmable control unit 76 having a CPU and memory. The control system includes a sensor 78 for measuring the level H of molten material in the furnace and in particular in the port and for providing an input to the control unit indicative of the level H of the material. Any suitable sensor arrangement can be used but in the present embodiment the sensor 78 is a laser sensor which measures the distance to the top of the molten metal in the port from a known reference point. Other measuring systems, which may include optical, mechanical, or ultrasound devices, can be used. The control system also includes a feedback arrangement for providing information to the control unit 76 regarding the position of the channel plate assembly. This may comprise the use of one or more encoders on the drive system but any suitable feedback system can be used. The control unit 76 may form part of an overall control unit for the furnace or it may be separate from other control systems on the furnace.

Operation of the apparatus 10 will now be described.

For use in a stirring mode to stir molten material in the furnace chamber 14, the channel plate assembly 26 is retracted from the port 16 as illustrated in FIG. 8A. The induction unit 24 is operated in a first direction so as to induce a downward flow of molten material along the inclined lower wall 18 into the furnace chamber 14. This sets up a circulatory flow of molten material in the furnace chamber as indicated by the arrows A in FIG. 8A.

When it is desired to extract the molten material from the furnace, for example for casting purposes, the apparatus 10 can be operated in an extraction mode. In the extraction mode, the induction unit 24 is operated in the reverse direction so as to induce an upward flow of molten material from the furnace chamber 14 along the lower wall of the port and the channel plate assembly 26 is introduced into the port to define an extraction channel 28. Initially the channel plate assembly 26 will be fully retracted and the control system 74 actuates the drive 64 so as to advance the channel plate assembly 26 into the port 16 until a leading edge region 58 only of the channel plate assembly immersed in the molten material to a predetermined depth D. Typically, the inclined lower wall 18 of the port extends upwardly beyond the level of the molten material so that the extraction channel 28 is defined between the channel plate assembly 26 and the inclined lower wall predominantly above the level H of the molten material, through which the molten material is driven by the induction unit 24 to enter the channel member 20. As the level H of the molten material falls, the control system 74 advances the channel plate assembly 26 so that part of the leading edge region 58 remains immersed in the molten material until the extraction process is complete.

Where the resolution of the drive system 64 permits, the control system 74 can be arranged to move the channel plate assembly 26 proportionally as the level H of the molten material falls, so that the leading edge region 58 is maintained at a substantially constant immersion depth D throughout the extraction process. This is illustrated in FIG. 8B to 8D.

Figure 9B:
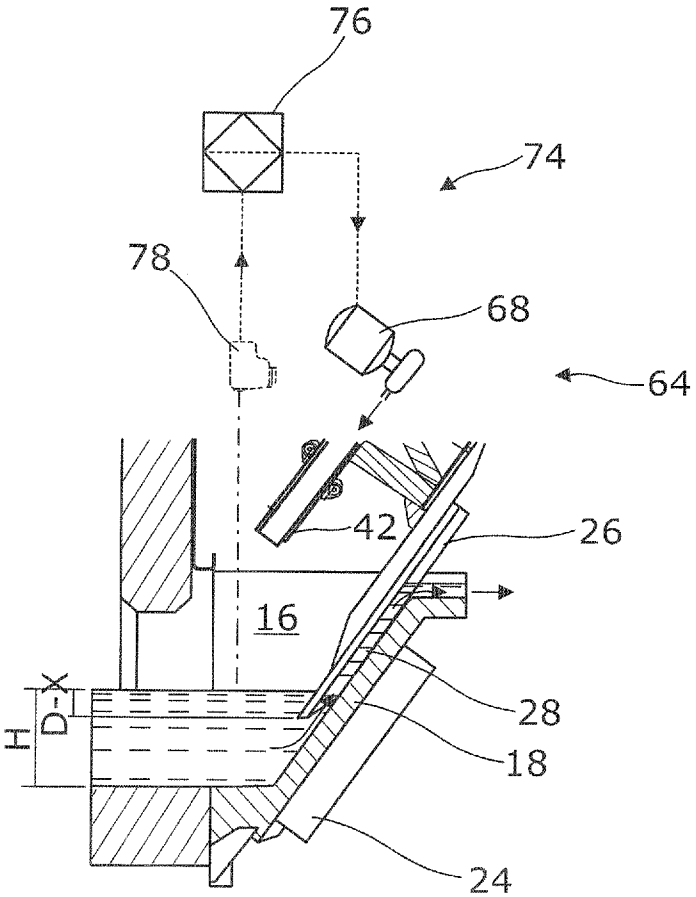
FIGS. 9A and 9B are a series of somewhat schematic views of part of the apparatus of FIGS. 2A to 2D illustrating sequentially a second method for advancing the channel plate assembly into the port when the apparatus is used in an extraction mode.
Figure 9A:
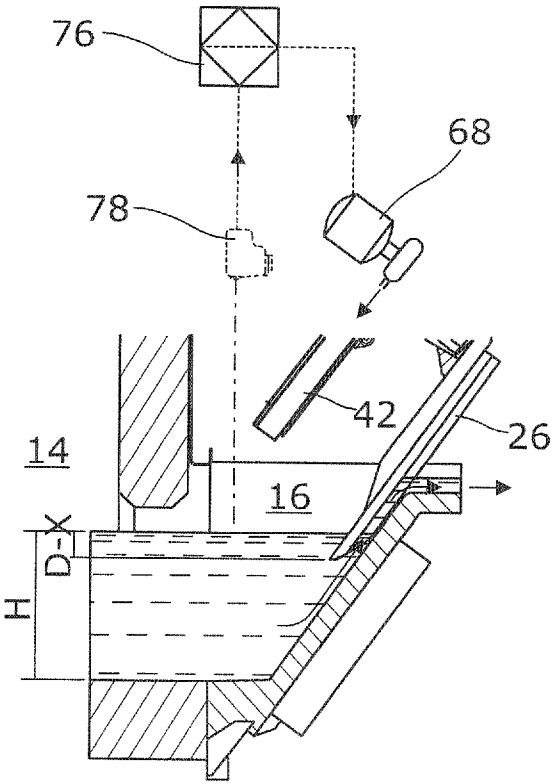

Alternatively, the control system 74 can be configured to advance the channel plate assembly 26 incrementally in discrete steps. In one embodiment which is illustrated in FIGS. 9A and 9B, the control system actuates the drive system 64 to advance the channel plate assembly 26 until the leading edge region 58 is immersed to predetermined mean immersion depth D plus an offset X. The channel plate assembly 26 is then held stationary as extraction continues until the immersion depth falls to D−X. The control system then re-actuates the drive system 64 to advance the channel plate assembly until the immersion depth returns to D+X. This step sequence advance is repeated until extraction is complete. The mean immersion depth D and the offset X can be calculated to suit any particular installation depending on the casting requirements and the physical geometry of the installation. In one embodiment, D has a range of 150 mm to 380 mm and X has a range of 40 mm to 60 mm.

The apparatus and methods in accordance with the invention provide a versatile system in which an induction unit mounted to an inclined lower wall of a furnace port can be used effectively to either stir the molten materials in the furnace or to pump the material out of the port for casting or other purposes. Because only a leading edge region of the channel plate assembly is immersed in the molten material, only the leading edge region need be constructed wholly from refractory material. The remainder of the channel plate assembly can be formed from a refractory lining applied to a metallic supporting structure. This has superior structural integrity when compared with a plate made entirely of refractory materials, allowing for the use of smaller refractory sections and easier maintenance.

Figure 11:
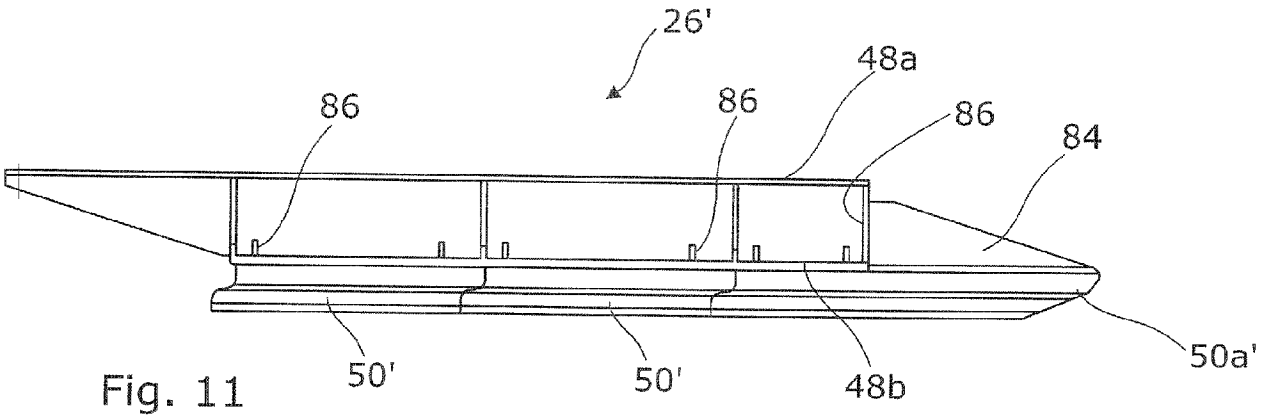
FIGS. 11 and 12 are similar to FIGS. 5 and 7 but showing a modified channel plate assembly.
Figure 12:
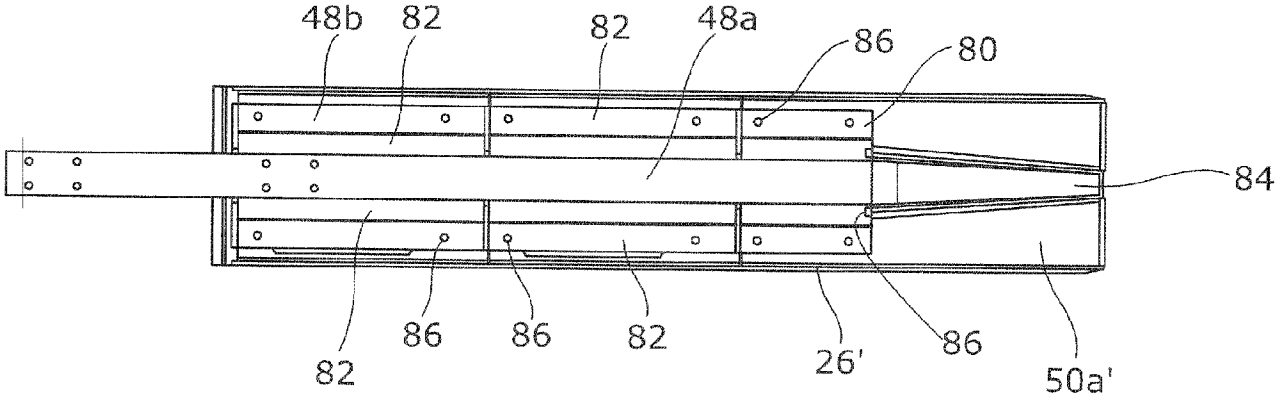

FIGS. 11 and 12 illustrate a modified the channel plate assembly 26' which can be used in the apparatus in accordance with the invention. The channel plate assembly 26' is substantially the same as the channel plate assembly 26 previously described and so only the differences will be described in detail.

In the modified channel plate assembly 26', the mounting portion 48*b*' of the framework to which the refractory plate sections 50' are mounted, is in the form of a laminated mounting plate 80. The laminated plate member 80 is formed from a number of longitudinal steel strips 82 welded together. In the present case, there are five strips 82 in the plate member 80 but there could be more or less than five as required. In tests the use of a laminated steel plate member 80 rather than a single solid mounting plate or a mounting frame has been shown to enhance the magnetic field produced by the induction unit 24. Whilst not wishing to be limited by any particular theory, it is believed that the laminated plate construction acts in the manner of a transformer core to enhance the magnetic field.

In the modified channel plate assembly 26', the leading refractory plate section 50*a*' projects further beyond the end of the framework 48' than in the previous embodiment 30 and the framework 48' is correspondingly shortened. The leading edge portion of the leading refractory plate section 50*a*' which projects beyond the supporting framework 48' has a central, wedge shaped fin 84 extending vertically upwardly on its rear or upper surface. The trailing end of the fin 84 abuts and is attached to the leading end of the raised mounting portion 48*a*' of the framework. 48'. This helps to resist bending forces, particularly in the leading refractory plate section 50*a*'. The fin 84 is an integral part of the leading refractory plate section 50*a*' and is made from refractory materials. Fixings 86 for attaching the refractory plates 50' to the framework 48' are cast into the refractory plates 50'. The fixings 86 may be in the form of studs having a screw thread for insertion though corresponding holes in the framework 48'.

It will be appreciated that the refractory plate arrangements used in the modified channel plate assembly 26' could be adapted for use with a framework 48 not having a laminated plate member 80 and vice-versa.

Whereas the invention has been described in relation to what is presently considered to be the most practical and preferred embodiment, it is to be understood that the invention is not limited to the disclosed arrangements but rather is intended to cover various modifications and equivalent constructions included within the spirit and scope of the invention.

Where the terms "comprise", "comprises", "comprised" or "comprising" are used in this specification, they are to be interpreted as specifying the presence of the stated features, integers, steps or components referred to, but not to preclude the presence or addition of one or more other feature, integer, step, component or group thereof.

The invention claimed is:

1. Apparatus for inducing flow in a molten material, the apparatus comprising a furnace having a furnace chamber, a port in fluid communication with the furnace chamber and having an inclined lower wall, a bi-directional induction unit mounted to the inclined lower wall of the port for inducing flow in molten material in the port, a retractable channel plate assembly selectively positionable in the port to define an extraction flow channel for the molten material between the channel plate assembly and the inclined lower wall, a drive arrangement for moving the channel plate assembly into and out of the port, a control system for controlling the drive system, the control system including a sensor system for measuring the level of the molten material in the port and a feedback system for providing information regarding the position of the channel plate assembly.

2. Apparatus as claimed in claim 1, in which the apparatus can be operated in an extraction mode to extract molten material from the furnace chamber through the port, the control system being configured when operated in the extraction mode to advance the channel plate assembly into the port continuously in response to a fall in the level of the molten material as detected by the sensor system to maintain a leading edge region immersed in the molten material substantially at a desired immersion depth D.

3. Apparatus as claimed in claim 1, in which the apparatus can be operated in an extraction mode to extract molten material from the furnace chamber through the port, the control system being configured when operated in the extraction mode to advance the channel plate assembly into the port incrementally in discrete steps in response to a fall in the level of the molten material as detected by the sensor system to maintain a leading edge region immersed in the molten material.

4. Apparatus as claimed in claim 3, in which the control system is configured to actuate the drive system to advance the channel plate assembly until the leading edge region is immersed to predetermined mean immersion depth D plus an offset X and to then hold the channel plate assembly stationary, the control system being configured to subsequently re-actuate the drive system to advance the channel plate assembly further when the immersion depth falls to D−X until the immersion depth returns to D+X and to repeat the step sequence advance until extraction is complete.

5. Apparatus as claimed in claim 1, in which a leading edge region of the channel plate assembly is made wholly of refractory materials.

6. Apparatus as claimed in claim 5, in which the channel plate assembly comprises a supporting structure made of non-refractory materials to which refractory materials are mounted to form the leading edge region and a lower face which defines the extraction flow channel.

7. Apparatus as claimed in claim 1, in which a lower face of the channel plate assembly which opposes the lower wall of the port is profiled to define the extraction flow channel.

8. Apparatus as claimed in claim 7, in which the lower face of the channel plate assembly is profiled to define a groove running along the length of the channel plate assembly.

9. Apparatus as claimed in claim 1, in which the channel plate assembly is mounted to a support for movement into and out of the port.

10. Apparatus as claimed in claim 9, in which the support is configured to hold the channel plate assembly in an insertion orientation in which a lower face of the channel plate assembly is aligned substantially parallel to the inclined lower wail of the port for insertion into the port.

11. Apparatus as claimed in claim 10, in which the support is movable so that the channel plate assembly can be moved away from the insertion orientation when it is retracted from the port.

12. Apparatus as claimed in claim 9, in which the support comprises a slide rail and a slide assembly mounted to the slide rail for movement along the rail, the channel plate assembly being mounted to or forming part of the slide assembly.

13. Apparatus as claimed in claim 12, in which the support is configured to hold the channel plate assembly in an insertion orientation in which a lower face of the channel plate assembly is aligned substantially parallel to the inclined tower wall of the part for insertion into the part, said support being movable so that the channel plate assembly can be moved away from the insertion orientation when it is retracted from the part, in which the slide rail is pivotally mounted to a stationary support frame for movement between an inclined position in which it supports the channel plate assembly in the insertion orientation and an upright position.

14. Apparatus as claimed in claim 9, in which the drive system is mounted on the support.

15. Apparatus as claimed in claim 1, in which the drive system comprises a ball screw actuator.

16. Apparatus as claimed in claim 1, in which the system for measuring the level of molten material comprises a laser measurement system.

17. Apparatus as claimed in claim 1, in which the control system comprises a programmable control unit having a CPU and memory.

18. Apparatus as claimed in claim 1, in which the furnace is a metal casting furnace.

19. A method of operating apparatus in accordance with claim 1, the method comprising: selectively operating the apparatus in either one of a stirring mode to stir molten material in the furnace or an extraction mode to draw molten material from the furnace chamber through the port.

20. A method as claimed in claim 19, in which when the apparatus is operated in the stirring mode, the method comprises operating the induction unit in a first direction so as to induce a downward flow of molten material from the port into the furnace chamber with the channel plate assembly retracted from the port.

21. A method as claimed in claim 19, in which when the apparatus is operated in the extraction mode, the method comprises operating the induction unit in a second direction so as to induce an upward flow of molten material from the furnace chamber along the lower wall of the port and using the drive system operating under the control of the control system to advance the channel plate assembly into the port so that only a leading edge region of the channel plate assembly is immersed in the molten material.

22. A method as claimed in claim 21, in which the method comprises advancing the control plate into the port continuously as the level of the molten material falls so as to maintain the leading edge region immersed in the molten material substantially at a desired immersion depth D.

23. A method as claimed in claim 21, in which the method comprises advancing the channel plate assembly incrementally in discrete steps as the level of the molten material falls.

24. A method as claimed in claim 23, in which the method comprises initially advancing the channel plate assembly from a retracted position until the leading edge is immersed to predetermined mean immersion depth D plus an offset X and holding the channel plate assembly stationary as molten material is extracted, advancing the channel plate assembly further once the immersion depth has fallen to D−X until the immersion depth returns to D+X and holding the channel plate assembly stationary again.

25. A method as claimed in claim 24, in which the method comprises repeating the step advance sequence until extraction is complete.

26. Apparatus as claimed in claim 6, in which the non-refractory materials are metal.

* * * * *